US009960563B2

(12) United States Patent
Moran et al.

(10) Patent No.: US 9,960,563 B2
(45) **Date of Patent: *May 1, 2018**

(54) CONNECTING ELECTRICAL EQUIPMENT THROUGH WIRING HARNESSES

(71) Applicant: EMERSON ELECTRIC CO., St. Louis, MO (US)

(72) Inventors: Michael J. Moran, St. Louis, MO (US); John J. Heller, St. Louis, MO (US); David L. Vie, Union, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/189,661

(22) Filed: Jun. 22, 2016

(65) Prior Publication Data

US 2016/0301177 A1 Oct. 13, 2016

Related U.S. Application Data

(63) Continuation-in-part of application No. 14/747,686, filed on Jun. 23, 2015.

(60) Provisional application No. 62/019,331, filed on Jun. 30, 2014.

(51) Int. Cl.

| | |
|---|---|
| ***H01R 25/00*** | (2006.01) |
| ***H01R 43/24*** | (2006.01) |
| ***H01R 9/03*** | (2006.01) |
| ***H01R 43/28*** | (2006.01) |

(52) U.S. Cl.

CPC ..... *H01R 43/24* (2013.01); *H01R 9/03* (2013.01); *H01R 43/28* (2013.01); *F24F 11/30* (2018.01)

(58) Field of Classification Search

CPC ..... H01R 43/24; H01R 43/28; H01R 9/03; H01R 4/20; B60R 16/0207; B60R 16/0215; H02G 15/06; H02G 15/064; H02G 15/068; H01B 17/16; H01B 17/20; H01B 17/306

USPC ..... 439/502, 638, 660, 692, 350, 357, 358; 174/73.1, 74 R, 75 R, 180, 84 R, 74 A

See application file for complete search history.

(56) References Cited

U.S. PATENT DOCUMENTS

| | | | | |
|---|---|---|---|---|
| 3,890,836 A | | 6/1975 | McKenzie et al. | |
| 4,487,463 A | * | 12/1984 | Tillotson | H01R 12/58 439/345 |
| 4,722,471 A | * | 2/1988 | Gray | B23K 35/0222 174/DIG. 8 |
| 4,852,252 A | * | 8/1989 | Ayer | H01R 43/0242 174/84 R |
| 4,942,499 A | | 7/1990 | Shibata et al. | |
| 5,072,185 A | * | 12/1991 | Rockwell | G01R 31/021 29/593 |
| 5,192,226 A | | 3/1993 | Wang | |
| 5,855,064 A | * | 1/1999 | Chang | H01R 27/00 29/861 |

(Continued)

*Primary Examiner* — Michael A Lyons
*Assistant Examiner* — Milagros Jeancharles
(74) *Attorney, Agent, or Firm* — Harness, Dickey & Pierce, P.L.C.

(57) ABSTRACT

In exemplary embodiments, wiring harness assemblies for electrical equipment and related methods are disclosed. In an exemplary embodiment, a wiring harness assembly for electrical equipment generally includes a first connector configured for connecting to a wiring harness, a second connector configured for mounting to a panel, and one or more conductors connecting the first connector with the second connector.

18 Claims, 7 Drawing Sheets

(56) References Cited

U.S. PATENT DOCUMENTS

| | | | | |
|---|---|---|---|---|
| 5,971,799 | A | 10/1999 | Swade | |
| 6,027,359 | A | 2/2000 | Aoki et al. | |
| RE37,368 | E | 9/2001 | Huppenthal et al. | |
| 6,383,011 | B2 | 5/2002 | Chen | |
| 6,531,657 | B1 * | 3/2003 | Jones, Jr. | H01R 31/06 174/112 |
| 6,641,433 | B2 * | 11/2003 | Devine | H01R 13/518 439/505 |
| 6,840,812 | B2 * | 1/2005 | Devine | H01R 13/518 439/505 |
| 7,112,969 | B1 * | 9/2006 | Thomas | G01R 31/041 324/503 |
| 7,182,654 | B1 * | 2/2007 | Gracki | F24C 7/06 219/452.12 |
| 7,313,000 | B2 | 12/2007 | Fiorentino et al. | |
| 7,442,076 | B2 * | 10/2008 | Huang | H01R 13/641 439/188 |
| 8,502,074 | B2 * | 8/2013 | Schutt | B29C 45/14336 174/110 R |
| 2006/0183353 | A1 * | 8/2006 | Butcher | H01R 27/00 439/35 |
| 2009/0099423 | A1 * | 4/2009 | Al-Ali | H01R 13/6275 600/300 |
| 2009/0101408 | A1 | 4/2009 | Koyama et al. | |
| 2009/0327768 | A1 * | 12/2009 | Chen | G06F 1/26 713/300 |
| 2011/0092833 | A1 * | 4/2011 | Farrior | A61B 5/04286 600/508 |
| 2013/0324027 | A1 | 12/2013 | Davis | |
| 2015/0369510 | A1 | 12/2015 | Lisbona | |
| 2015/0372415 | A1 | 12/2015 | Ishihara et al. | |

* cited by examiner

CONNECTING ELECTRICAL EQUIPMENT THROUGH WIRING HARNESSES

CROSS-REFERENCE TO RELATED APPLICATIONS

This application is a continuation-in-part of U.S. patent application Ser. No. 14/747,686 filed on Jun. 23, 2015, which claims the benefit of, and priority to, U.S. Provisional Application No. 62/019,331 filed on Jun. 30, 2014. The entire disclosures of the above applications are incorporated herein by reference.

FIELD

The present disclosure relates to connecting electrical equipment through wiring harnesses.

BACKGROUND

This section provides background information related to the present disclosure which is not necessarily prior art.

In various indoor and outdoor heating, ventilation, and air-conditioning (HVAC) systems, wiring harnesses are used to connect HVAC equipment to controls. A harness may be used, e.g., to connect various elements of a furnace (e.g., gas valve, inducer, circulator, pressure switches, flame probe, temperature switches) to an integrated furnace control.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The inventors have observed that indoor and outdoor HVAC controls are being produced with increasing levels of complexity. For example, furnace harnesses are typically used to connect various elements of a furnace (e.g., gas valve, inducer, circulator, pressure switches, flame probe, temperature switches, etc.) to furnace control boards. Some existing furnace harnesses employ wire-to-board connectors. A given furnace harness may include a multi-pin female connector for connection to a male pin connector that is board-mounted on a furnace control board. The inventors have also observed that some furnace manufacturers use male board-mounted header pin connectors with various numbers of pins arranged in a single row for connection with wiring harnesses having a mating female connector.

In some cases, aftermarket furnace control boards may be used to replace existing OEM furnace control boards in gas furnaces. Various existing control boards have printed circuit board (PCB) mounted headers with wire-to-board connectors. However, the inventors have observed that male header pins typically are not designed to be incorporated into wiring assemblies. Accordingly, in various embodiments of the disclosure, a wiring harness assembly for electrical equipment is provided that generally includes a first connector configured for connection with a wiring harness, a second connector configured for mounting, e.g., to a panel, and at least one conductor connecting the first connector with the second connector. In various embodiments, the first connector is a male connector connectible with a wiring harness female connector.

The following descriptions provided with reference to the figures are meant to be illustrative of possible example components and configuration details, and are not meant to be limiting. Accordingly, it should be understood that other or additional furnace components, connectors, wiring arrangements, and/or configurations may be provided in other embodiments without departing from the scope of the present disclosure. It also should be understood that the disclosure is not limited to controls and connections for use in furnaces. Aspects of the disclosure may be practiced in relation to controls, connections, control boards, wiring arrangements, control panels, etc. for various types of electrical equipment.

Figure 1:
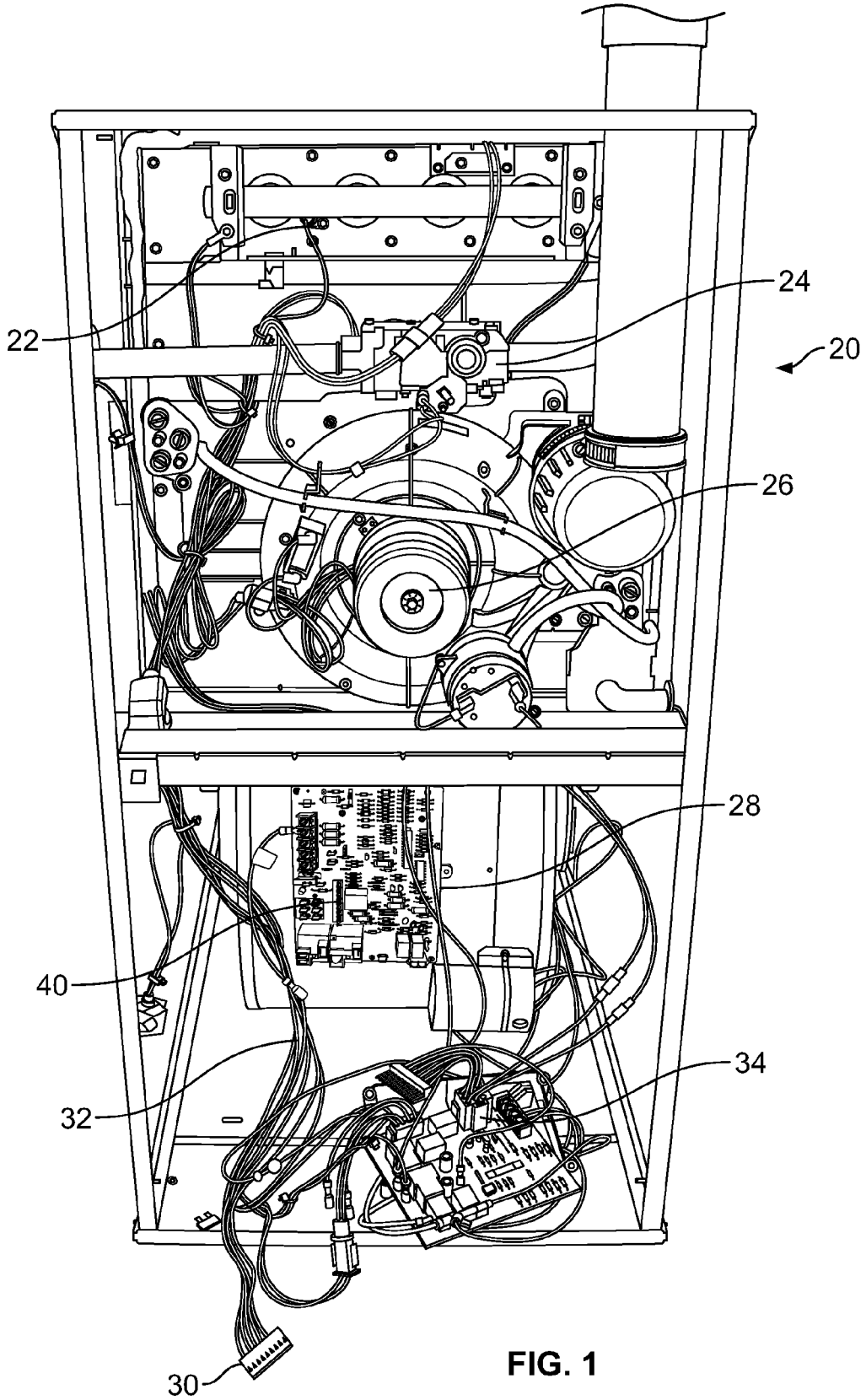
FIG. 1 illustrates an example gas furnace having an existing furnace control board, the figure also showing a replacement control board configured with an example wiring harness assembly in accordance with an exemplary implementation of the present disclosure.

With reference to the figures, FIG. 1 illustrates an example furnace 20. The furnace 20 is, e.g., a gas-fired furnace that includes in-shot burners 22, a gas valve 24, and an inducer fan 26. The gas furnace 20 is operable using a furnace control panel 28 that may be equipment manufacturer (OEM)-provided. The furnace control panel 28 includes an in-line connector 40.

Figure 2:
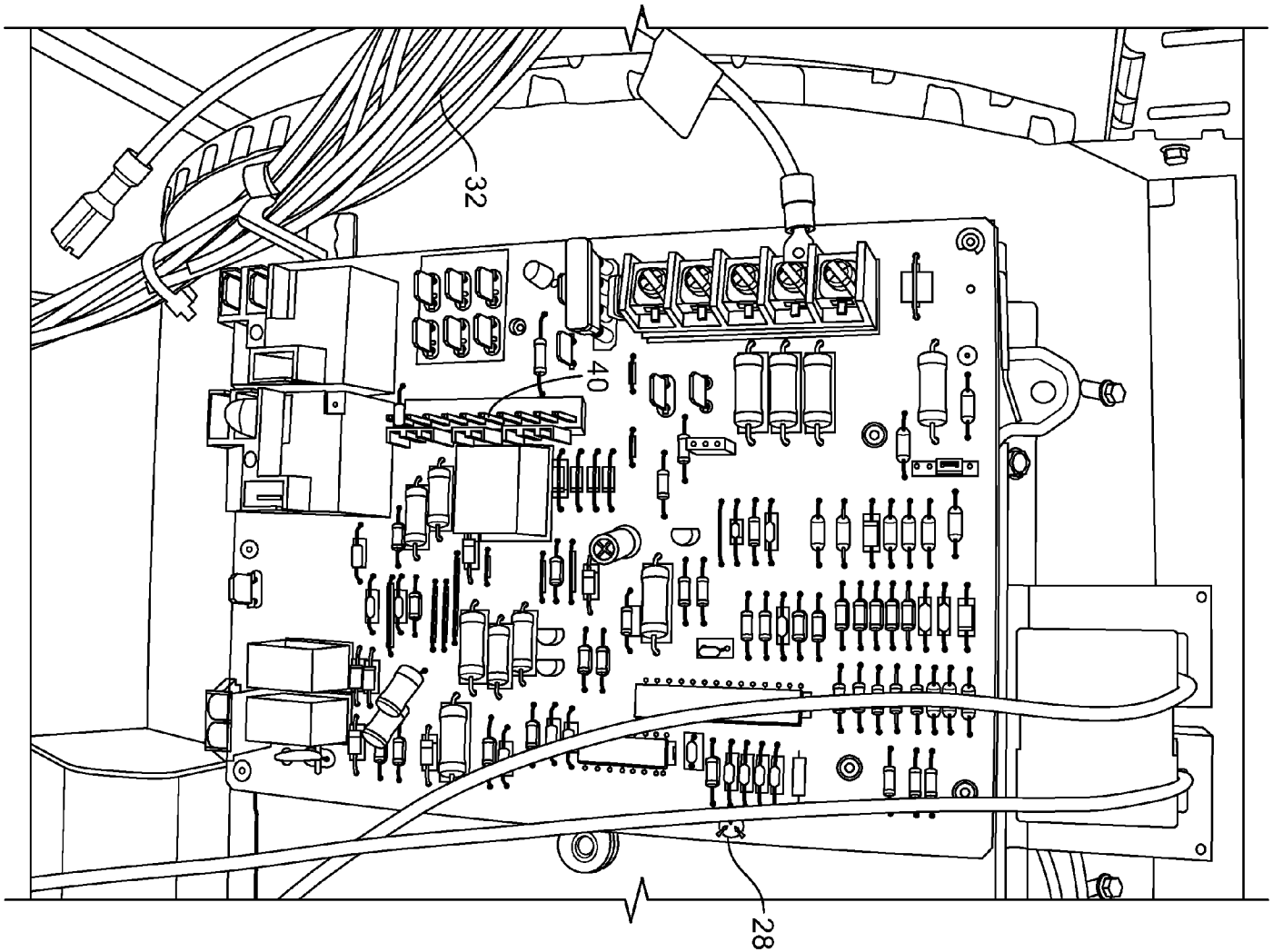
FIG. 2 illustrates the existing furnace control board illustrated in FIG. 1.
Figure 3:
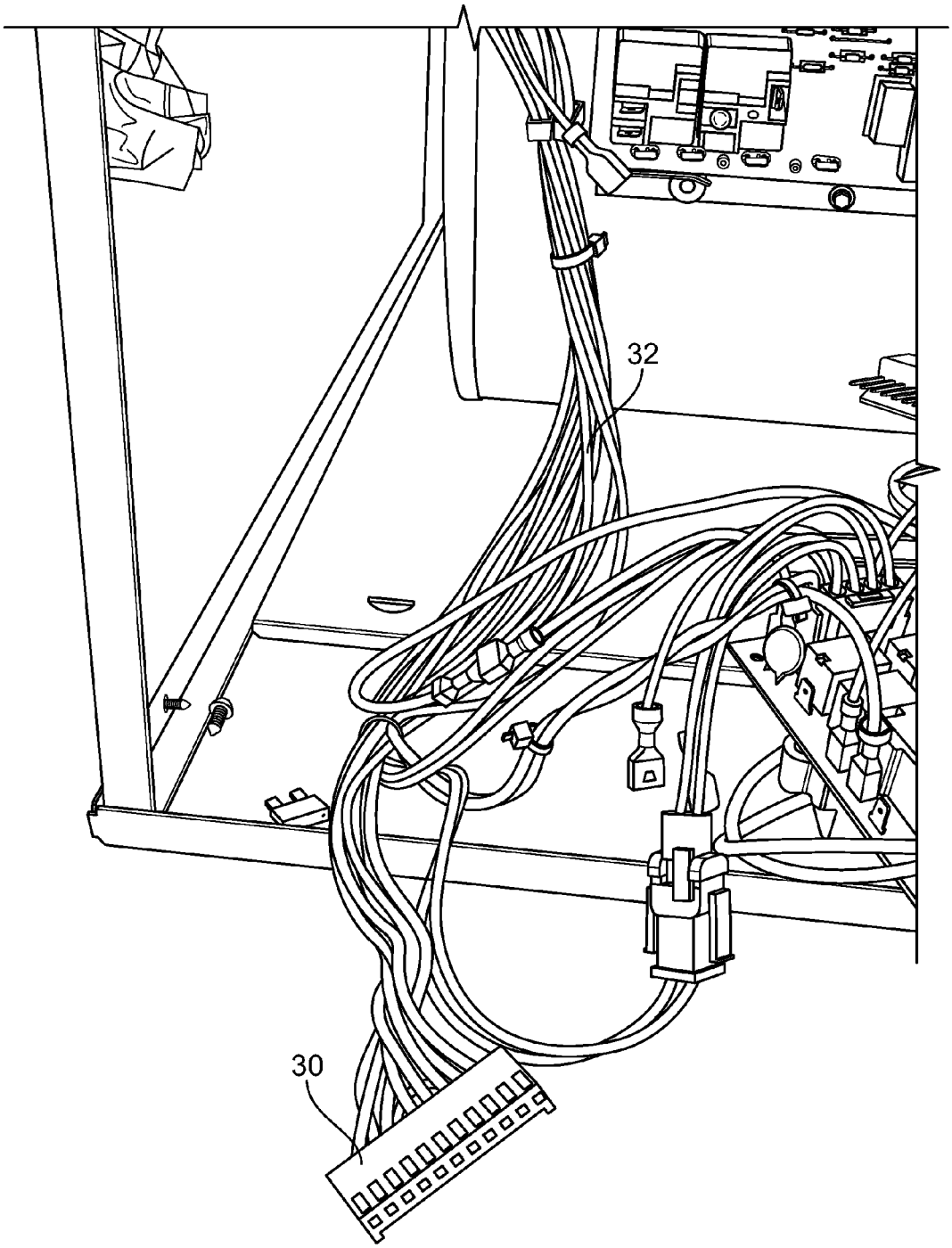
FIG. 3 illustrates an existing wiring harness connected in the gas furnace shown in FIG. 1.

FIG. 2 illustrates the OEM furnace control panel 28 of FIG. 1. The wire-to-board male header pin connector 40 is, e.g., an 11-position AMP® SL-156 connector at a 3.96 millimeter pitch. As shown in FIGS. 2 and 3, an existing furnace wiring harness 32 is provided for connecting various furnace components with the furnace control panel 28. The existing furnace wiring harness 32 has a female connector 30, e.g., a female AMP® SL-156 series 11-position connector. The female connector 30 is designed to connect to the male header pin connector 40 of the existing furnace control panel 28. Although FIGS. 2 and 3 illustrate one example OEM furnace control panel and connection type, it should be understood that various aspects of the disclosure may be practiced in relation to other types of control panels and/or connectors without departing from the scope of the present disclosure.

In the present example implementation, a replacement furnace control panel 34, e.g., an aftermarket furnace control panel, is provided to replace the furnace control panel 28. The existing furnace wiring harness 32 is to remain connected in the furnace 20 when the replacement control panel 34 is installed in the furnace 20. As shown in greater detail in FIG. 4, an example embodiment of a wiring harness assembly 38 is provided and configured to connect the replacement furnace control panel 34 with the existing furnace harness 32.

Figure 4:
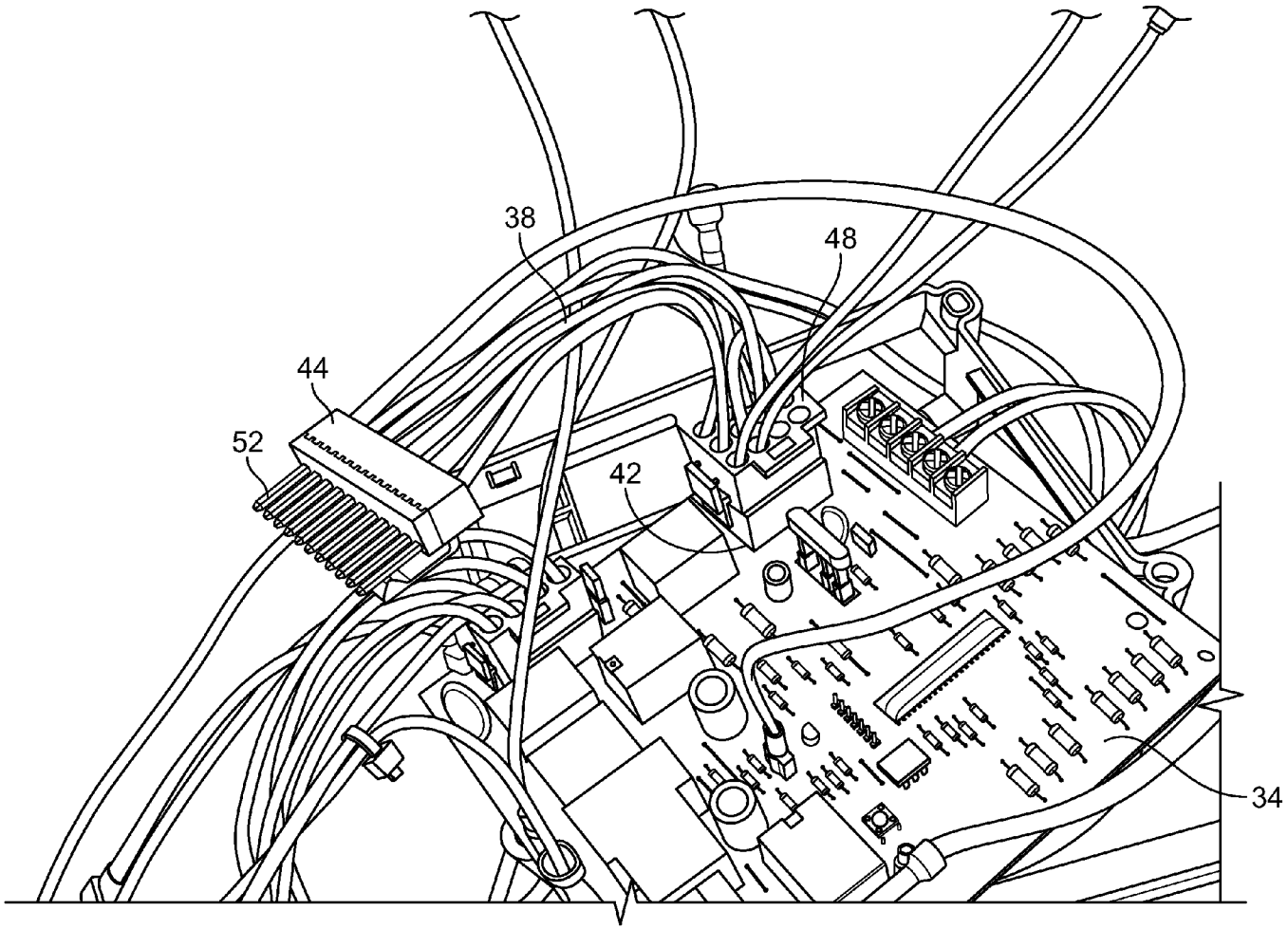
FIG. 4 illustrates an example embodiment of a wiring harness assembly configured with a replacement furnace control board in accordance with an exemplary implementation of the present disclosure.

FIG. 4 illustrates the example replacement furnace control panel 34 and wiring harness assembly 38 for connecting the replacement control panel 34 to the existing furnace harness female connector 30. In the present example embodiment, the replacement control panel 34 is aftermarket equipment and includes, e.g., a universal furnace control board or panel assembly. The replacement control panel 34 has a board-mounted connector 42 to which a connector 48 of the harness assembly 38 is connected. The board-mounted connector 42 is different from the board-mounted in-line connector 40 of the existing furnace control panel 28. Thus, in the present example embodiment, the wiring harness assembly 38 includes an encapsulated male header pin connector 44 in which pins 52 are provided, e.g., in a board-mount configuration but adapted for use in wire-to-wire cable assemblies. Therefore the male header pin connector 44 can be used, e.g., in a harness assembly to connect to a female header connector that is part of an existing wiring harness, such as the female connector 30 shown in FIG. 3. It should be understood that other replacement furnace control boards and/or wiring harness assemblies may be used in other embodiments, and may depend on the existing OEM furnace control board and/or furnace harness connector types. Various numbers, alignments, and/or configurations of pins may be provided in various embodiments. Unless otherwise indicated, the terms "board," "panel" and the like may be used herein and in the claims to refer to a board, panel, or other rigid structure connectible with a wiring harness through an embodiment of a wiring harness assembly in accordance with one or more aspects of the disclosure.

Figure 5:
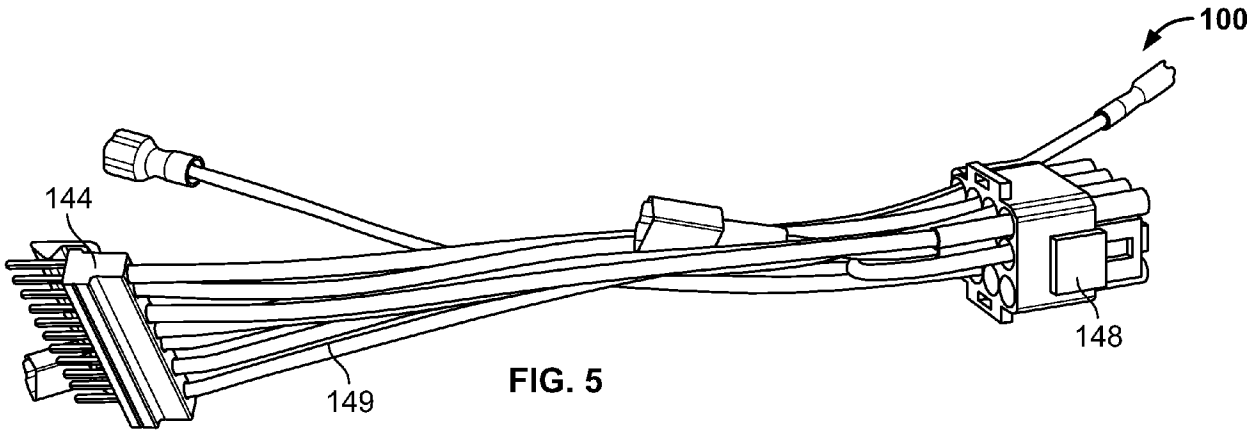
FIG. 5 illustrates an example embodiment of a wiring harness assembly in accordance with an exemplary implementation of the present disclosure.

FIG. 5 illustrates an example embodiment of a wiring harness assembly 100 for electrical equipment. As shown, the wiring harness assembly 100 includes a first connector 144 configured for connection with a wiring harness (e.g., with a female connector of a furnace control wiring harness), and a second connector 148 configured for mounting to a panel (e.g., to a furnace control board.) The wiring harness assembly 100 includes at least one conductor 149 connecting the first connector 144 with the second connector 148. In the example embodiment shown in FIG. 5, a plurality of conductors 149 connect the first connector 144 and second connector 148. The conductors 149 are sufficiently flexible so as to allow the wiring harness assembly 100 to be positioned appropriately in relation to nearby electrical equipment when a wiring harness and panel are connected through the assembly 100. In the present example embodiment, each conductor 149 includes insulated wiring. In various embodiments, conductors 149 may include any suitable material capable of transmitting signals between the first and second connectors 144 and 148.

In the example embodiment shown in FIG. 5, the second connector 148 is a matrix crimp housing plug, e.g., a Molex® MLX Series Power Connector. In various embodiments, a second connector may be configured for wire-to-wire connections, wire-to-board connections, etc. A second connector embodiment may have, e.g., male pin and female socket terminals, male and female connector housings, etc., which, e.g., may be used interchangeably in a given harness assembly or wiring application. In various embodiments, the second connector 148 may be any suitable connector type, and, e.g., may correspond to the type of connector used on an aftermarket furnace control board. In the present example embodiment, the first and second connectors 144 and 148 are configured to allow, e.g., an aftermarket furnace control board to be used to replace an OEM furnace control board having a different board-mounted connector than that of the aftermarket furnace control board.

Figure 6:
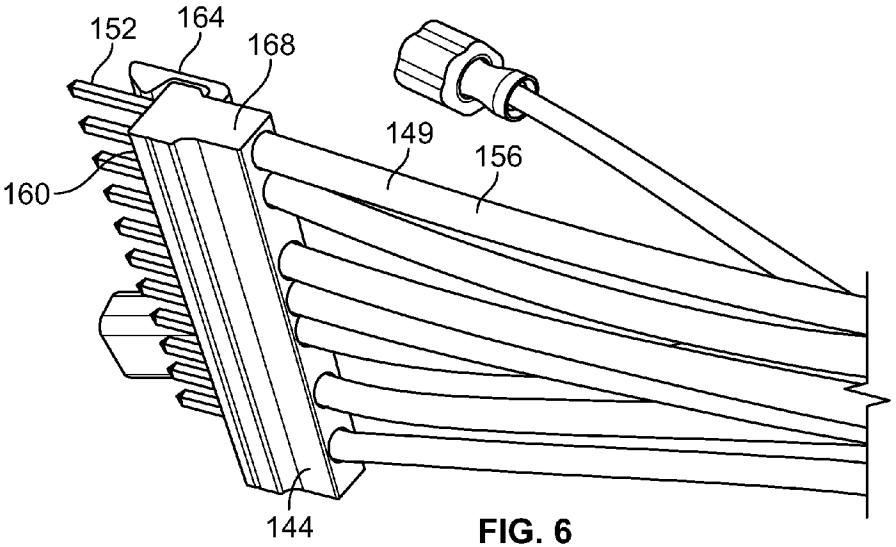
FIG. 6 illustrates an example embodiment of a connector of a wiring harness assembly in accordance with an exemplary implementation of the present disclosure.

FIG. 6 illustrates in greater detail the first connector 144 of the wiring harness assembly 100. Each conductor 149 includes an outer insulating layer 156. The first connector 144 includes a board mount male header 160, e.g., an in-line 11-pin Molex® KK series PCB header assembly. A wall 164 of the header 160 extends alongside a plurality of linearly aligned pins 152. The wall 164 is configured, e.g., as a friction lock to retain a corresponding portion of a corresponding female connector (not shown in FIG. 6) when the female connector is connected with the first connector 144 via the pins 152. In other embodiments, a header could include other or additional features, e.g., for providing support and/or connection with and/or retention of a corresponding connector. Selected pins 152 are connected with wiring of corresponding conductors 149, and a housing 168 of molding material is provided around the wiring/pin connections. The molding material may be applied, e.g., as a resin coating and may include, e.g., a hot melt grade of polyamide (e.g., nylon), such as ELVAMIDE®, TECHNOMELT®, etc. In various embodiments, other or additional materials and/or structures could be used to provide molding material, a housing, support, and/or protection for wiring/pin connections.

In various implementations in which the first connector 144 is connectible with a female connector of an existing furnace harness, a replacement furnace control board could be used that has a different connector type than that of an existing OEM furnace control. For example, if an existing furnace harness has a female connector for connecting to an in-line male header pin connector of the OEM furnace control board, a connector such as the first connector 144 may allow a replacement control board to be connected to the female connector of the existing furnace harness, even if the replacement control board does not include a male header pin connector. It should be understood that other first connector types may be used in other embodiments, dependent on, e.g., a type of female connector provided on an existing furnace harness.

Figure 7B:
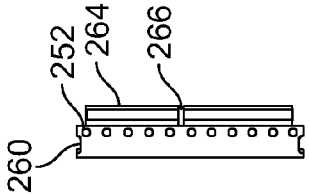
FIG. 7B is an end view of a portion of the example wiring harness assembly shown in FIG. 7A, the view taken along lines B-B of FIG. 7A.
Figure 7A:
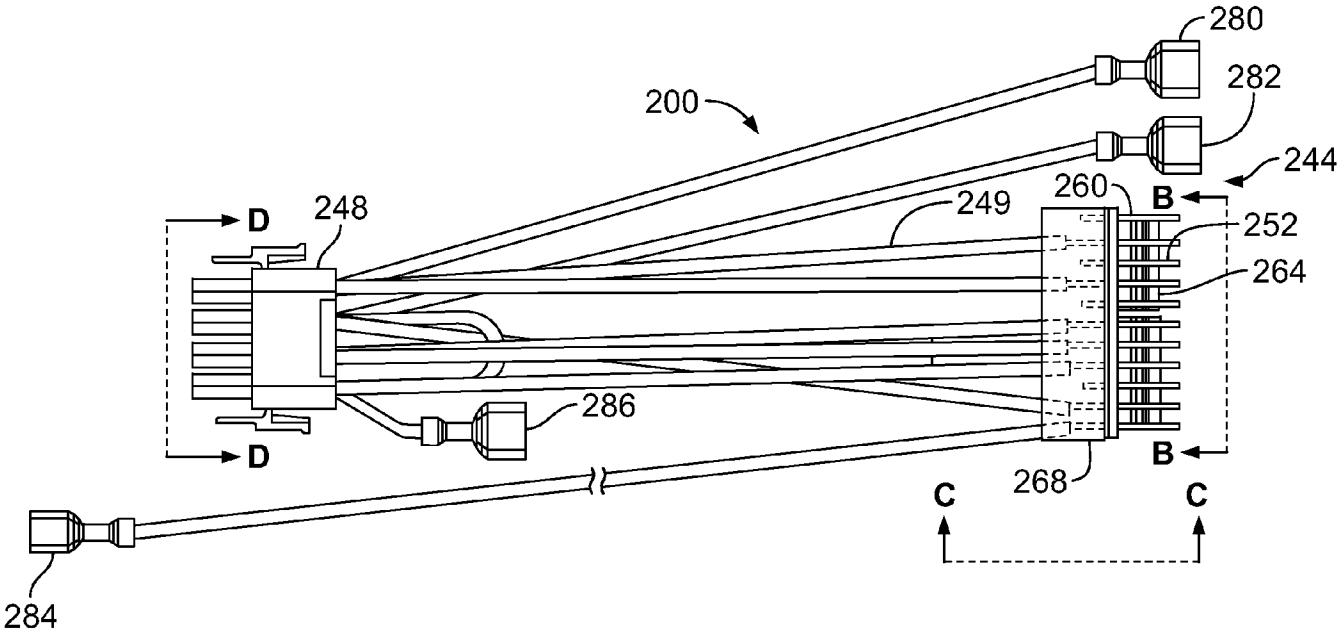
FIG. 7A is a top view of an example embodiment of a wiring harness assembly in accordance with an exemplary implementation of the present disclosure.

FIGS. 7A through 7D illustrate an example wiring harness assembly 200. As shown in FIG. 7A, the assembly 200 includes a first connector 244 configured for connection with a wiring harness (e.g., with a female connector of a furnace control wiring harness), and a second connector 248 configured for mounting to a panel (e.g., to a furnace control board.) The second connector 248 may be, e.g., a matrix crimp housing plug (e.g., Molex® MLX type power connector). The wiring harness assembly 200 includes at least one conductor 249 connecting the first connector 244 with the second connector 248.

The first connector 244 of the wiring harness assembly 200 includes an in-line PCB header 260. As shown more clearly in FIG. 7B, the header 260 includes a wall 264 extending alongside the pins 252. The wall 264 is configured, e.g., as a friction lock to retain a corresponding portion of a corresponding female connector (not shown in FIGS. 7A-7D) when the female connector is connected with the first connector 244 via the pins 252. The wall 264 includes a slot 266, which may be used, e.g., to indicate circuit locations. In various embodiments, such a wall may include one or more slots or may extend continuously alongside a plurality of pins. The header 260 is connected with a housing 268 made, e.g., from a molding material such as a lower melting-point nylon multipolymer resin, e.g., DuPont™ Elvamide®, sometimes referred to as a hot melt resin.

Figure 7C:
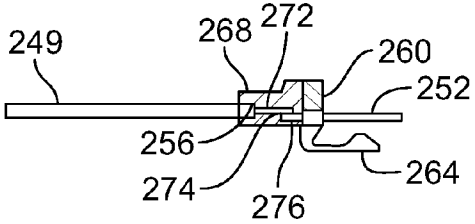
FIG. 7C is a side view of a portion of the example wiring harness assembly shown in FIG. 7A, the view taken along lines C-C of FIG. 7A.
Figure 7D:
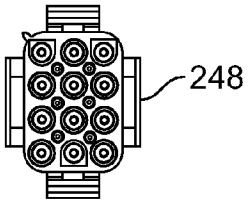
FIG. 7D is an end view of a portion of the example wiring harness assembly shown in FIG. 7A, the view taken along lines D-D of FIG. 7A.

The housing 268 is provided around connections between pins 252 and corresponding conductors 249. For example, as shown in FIG. 7C, pins 252 of the header 260 are soldered with corresponding wire ends 272 at solder joints 274 to provide electrical connections between the pins 252 and conductors 249. The housing 268 is formed, e.g., when the solder joints 274 are surrounded with a hot melt resin, e.g., to protect the solder connections from moisture and/or contact. The molding material may also act as a strain relief for the solder connections.

To join a pin 252 and a corresponding conductor 249, insulation 256 is stripped from an end 272 of the corresponding conductor 249. A portion 276 of the corresponding pin 252 is soldered (e.g., butt soldered) to the stripped insulated wire end 272 to form a solder joint 274, e.g., as shown in FIG. 7C. The wire may be soldered, e.g., to a side of the male header pin that, in a board mount configuration, would normally be through-hole soldered to a board. As can be seen in FIG. 7A, some, but not necessarily all, pins 252 may be used in some harness assembly embodiments. In some other embodiments, all of the pins 252 may be used to provide connections through a given harness assembly.

In various embodiments a wiring harness assembly may include additional connectors. For example, as shown in FIG. 7A, a terminal 280 is configured for connection with a 24-volt alternating current (VAC) hot line of a transformer. A terminal 282 may be provided for connection with a 24 VAC transformer return line. A terminal 284 may be provided to connect, e.g., to a flame probe. A terminal 286 may be provided for connection, e.g., with a 24 VAC humidification line. It should be understood that more, fewer, and/or other types of additional connectors, or no additional connectors, may be used in other embodiments, without departing from the scope of the present disclosure.

According to another example embodiment, a method of making a wiring harness assembly for electrical equipment is disclosed. The method may include soldering one or more conductor wires to one or more corresponding board-mount male header pins to create one or more solder joints, and molding material around the solder joint(s) to protect the solder joint(s) from moisture and/or contact, and to provide strain relief to the solder joint(s). The molding material may include a hot melt grade of polyamide. The conductor wire(s) may each be soldered to a side of the corresponding male header pin where the pin is in a board-mount configuration normally designed, e.g., to be through-hole soldered to a board. In various embodiments, the board-mount configured male header pin(s) are connectible with a female connector, e.g., of a furnace wiring harness. The method may further include connecting, e.g., soldering, a matrix crimp housing plug to opposite end(s) of the conductor wire(s) connected with the male header pin(s). In various embodiments, the matrix crimp housing plug is compatible with a furnace control board.

Figure 8:
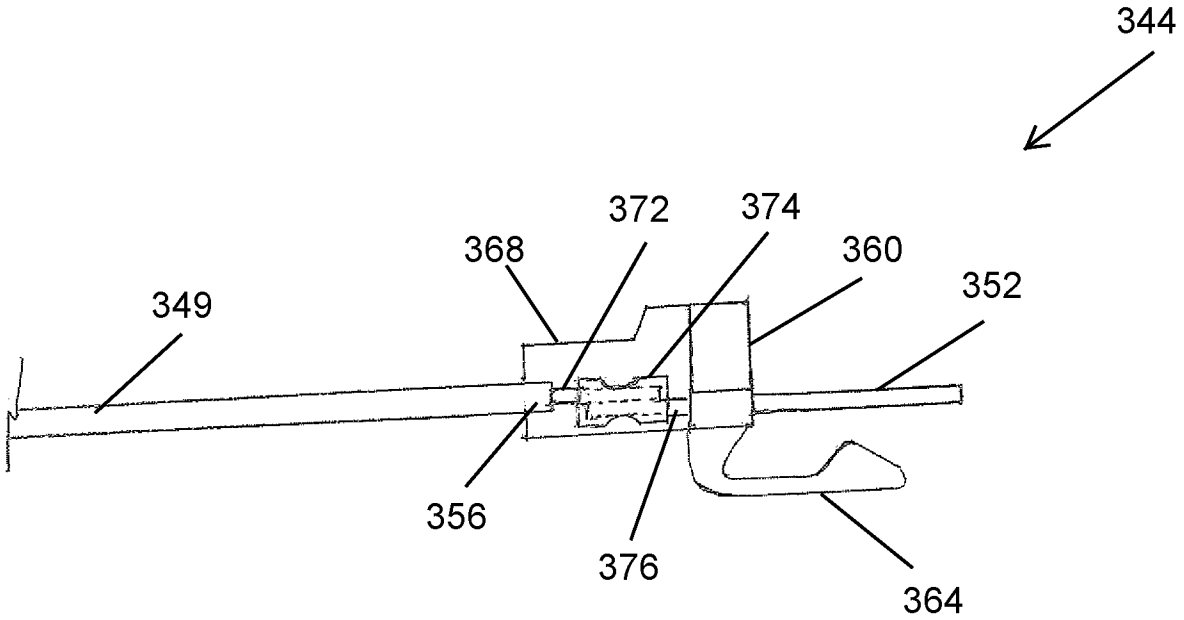
FIG. 8 is a side sectional view of an example connector of a wiring harness assembly in accordance with an exemplary implementation of the present disclosure.

FIG. 8 illustrates another example embodiment of a first connector 344 configured for connection with a wiring harness (e.g., with a female connector of a furnace control wiring harness). An in-line PCB header 360 includes a wall 364 extending alongside pins 352. The wall 364 is configured, e.g., as a friction lock to retain a corresponding portion of a corresponding female connector when the female connector is connected with the first connector 344 via the pins 352. The wall 364 includes a slot (not shown) that may be used, e.g., to indicate circuit locations. In various embodiments, such a wall may include one or more slots or may extend continuously alongside a plurality of pins. The header 360 is connected with a housing 368 made, e.g., from a molding material such as a hot melt resin.

The housing 368 is provided around connections between pins 352 and corresponding conductors 349. In the example first connector 344, pins 352 of the header 360 are splice-connected with corresponding wire ends 372, e.g., by splice connector 374 to provide electrical connections between the pins 352 and conductors 349. When the housing 368 is formed, e.g., the splice connectors 374 are surrounded with a hot melt resin, e.g., to protect the splice connections from moisture and/or contact. The molding material may also act as a strain relief for the splice connections.

To join a pin 352 and a corresponding conductor 349, insulation 356 is stripped from an end 372 of the corresponding conductor 349. A portion 376 of the corresponding pin 352 is splice-connected to the stripped wire end 372. It should be noted that the header 360 and pins 352 are board-mount configured. If the header 360 and pins 352 were used in a conventional board-mount application, the portion 376 of the male header pin would be through-hole soldered to a board. Various types of splice connectors 374 may be used. For example, the splice connector 374 shown in FIG. 8 is a crimp-type connector. Various crimp-type connectors, including but not limited to barrel crimp connectors, could be used to electrically connect conductors with pins in various embodiments. Example splice connectors include, e.g., Molex® butt splice connectors, Molex® parallel splice connectors, etc.

According to another example embodiment, a method of making a wiring harness assembly for electrical equipment is disclosed. The method may include connecting one or more conductor wires to one or more corresponding male header pins to create one or more connections, e.g., splice connections, and molding material around the connection(s) to protect the connection(s) from moisture and/or contact, and to provide strain relief to the connection(s). The molding material may include a hot melt grade of polyamide. The conductor wire(s) may each be connected with a corresponding male header pin where the pin is in a board-mount configuration normally designed, e.g., to be through-hole soldered to a board. In various embodiments, the board-mount configured male header pin(s) are connectible with a female connector, e.g., of a furnace wiring harness. The method may further include connecting a matrix crimp housing plug to opposite end(s) of the conductor wire(s) connected with the male header pin(s). In various embodiments, the matrix crimp housing plug is compatible with a furnace control board.

In various embodiments, a replacement furnace control board can be used in a furnace where the replacement control board includes a different connector type than that of an existing OEM furnace control panel. In some embodiments, wiring harness assemblies can allow electrical connections to be made between matrix PCB headers and in-line style plug crimp terminal housings, without the need to use or develop a furnace control board having an in-line PCB header. For example, some embodiments may allow a replacement furnace control board having a matrix PCB header to be used to replace an existing OEM furnace control board having either matrix style or in-line style PCB headers. In some cases, if an existing OEM furnace control board has a matrix style header, the existing OEM furnace harness may be connected directly to the replacement OEM furnace control boards. However, even if an existing OEM furnace control board has an in-line style header, embodiments of furnace harness assemblies may be used to allow connection of a replacement furnace control board to the existing OEM in-line furnace harness female connector. In some embodiments, a control panel kit may include a replacement control panel for installation in relation to a given furnace or other piece of equipment, and a wiring harness assembly configured to allow connection of the replacement control panel with a wiring harness previously provided with the furnace or other piece of equipment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector for use in electrically connecting a piece of electrical equipment with a female connector through one or more conductors, the connector comprising:

a male header pin connector having a header and a plurality of pins extending through the header, each pin having a first end connectible with a female connector and an exposed portion extending alongside and past a locking wall of the header, and a second end connected with an end of a corresponding one of one or more conductors; and a protective housing abutting the header and surrounding the one or more connections between the one or more pin second ends and conductor ends;

wherein the exposed portions of the plurality of pins are connectible with a female connector of a furnace wiring harness, the locking wall having a configuration suitable for frictionally locking the male header pin connector to the female connector of the furnace wiring harness.

2. The connector of claim 1, wherein the housing comprises one or more of the following: a molding material, and hot melt grade of polyamide.

3. The connector of claim 1, wherein the one or more connections between the one or more pin second ends and conductor ends comprise one or more of the following: a splice connection and a crimp connection.

4. A wiring harness assembly comprising the connector of claim 1.

5. A control panel kit comprising the connector of claim 1.

6. The connector of claim 1, wherein:

the one or more connections between the one or more pin second ends and conductor ends comprise one or more splice connections; and the protective housing comprises a molding material surrounding the one or more splice connections.

7. The connector of claim 1, wherein:

the one or more connections between the one or more pin second ends and conductor ends comprise one or more barrel crimp connections; and the protective housing comprises a molding material surrounding the one or more barrel crimp connections.

8. A method of making a wiring harness assembly for electrical equipment, the method comprising:

using one or more splice connectors, connecting one or more conductor wires with a plurality of corresponding pins of a male header pin connector to make one or more splice connections; and applying a molding material around the one or more splice connections to cover the one or more splice connections;

whereby a connector of the wiring harness assembly is configured for connecting the conductor wires to an existing wiring harness;

wherein the plurality of pins have an exposed portion extending alongside and past a locking wall of the male header pin connector and connectible with a female connector of a furnace wiring harness, the locking wall having a configuration suitable for frictionally locking the male header pin connector to the female connector of the furnace wiring harness.

9. The method of claim 8, wherein the molding material includes one or more of the following: a resin, and a hot melt grade of polyamide.

10. The method of claim 8, wherein using one or more splice connectors comprises:

positioning a conductor wire end in a first side of a barrel crimp connector;

positioning a corresponding pin end in a second side of the barrel crimp connector; and crimping the barrel crimp connector.

11. The method of claim 8, wherein a plurality of conductor wires are spliced with a plurality of pins at first ends of the conductor wires, the method further comprising connecting a matrix crimp housing plug to the conductor wires at second ends of the conductor wires.

12. The method of claim 11, wherein the matrix crimp housing plug is connectible with a furnace control board.

13. A wiring harness assembly for electrical equipment, the assembly comprising:

a male header pin connector configured for connecting to a wiring harness;

a board connector configured for mounting to a panel;

one or more conductors connecting the male header pin connector with the board connector;

the one or more conductors coupled with the male header pin connector by one or more splice connections; and a molding material surrounding the one or more splice connections;

wherein the male header pin connector comprises a plurality of pins having an exposed portion extending alongside and past a locking wall of the male header pin connector and connectible with a female connector of a furnace wiring harness, the locking wall having a configuration suitable for frictionally locking the male header pin connector to the female connector of the furnace wiring harness.

14. The wiring harness assembly of claim 13, further comprising one or more crimp connectors in which the one or more splice connections are made.

15. A method of replacing a piece of electrical equipment using an existing wiring harness, the method comprising:

connecting a first end of a wiring harness assembly with the existing wiring harness, the first end including a male header pin connector having a plurality of pins connected with one or more corresponding wires at one or more pin-wire connections and extending alongside and past a locking wall of the male header pin connector, and protective molding material around the one or more pin-wire connections; and connecting a second end of the wiring harness assembly with a replacement piece of electrical equipments;

wherein the plurality of pins have an exposed portion extending alongside and past a locking wall of the male header pin connector and connectible with a female connector of a furnace wiring harness, the locking wall having a configuration suitable for frictionally locking the male header pin connector to the female connector of the furnace wiring harness.

16. The method of claim 15, performed to replace a furnace control panel.

17. The method of claim 15, wherein connecting the second end of the harness assembly comprises connecting a matrix crimp housing plug with a control board of the replacement piece of electrical equipment.

18. The method of claim 15, wherein connecting the first end of the wiring harness assembly comprises positioning the locking wall of the male header pin connector onto the existing wiring harness.

* * * * *